United States Patent [19]

Takahashi et al.

[11] Patent Number: 4,601,963

[45] Date of Patent: Jul. 22, 1986

[54] LOCALLY DEFORMABLE PHOTOSENSITIVE DRUM FOR USE IN ELECTROPHOTOGRAPHY

[75] Inventors: Michio Takahashi; Mitsuo Tanaka, both of Machida; Fuchio Kanno, Yokohama; Kazuo Kobayashi, Kawasaki, all of Japan

[73] Assignee: Ricoh Company, Ltd., Japan

[21] Appl. No.: 600,894

[22] Filed: Apr. 16, 1984

[30] Foreign Application Priority Data

| | | | |
|---|---|---|---|
| Apr. 15, 1983 | [JP] | Japan | 58-65644 |
| Apr. 15, 1983 | [JP] | Japan | 58-65645 |
| Apr. 15, 1983 | [JP] | Japan | 58-65646 |

[51] Int. Cl.[4] ..... G03G 5/10

[52] U.S. Cl. ..... 430/69; 430/56; 355/3 DR

[58] Field of Search ..... 430/69, 56; 355/3 BE, 355/3 DR

[56] References Cited

U.S. PATENT DOCUMENTS

| | | | |
|---|---|---|---|
| 3,928,036 | 12/1975 | Jones | 430/69 |
| 4,063,809 | 12/1977 | Schrempp et al. | 355/3 DR |
| 4,113,372 | 9/1978 | Kimura et al. | 355/3 DR |
| 4,258,113 | 3/1981 | Kuehnle | 355/3 DR |

*Primary Examiner*—John L. Goodrow

*Attorney, Agent, or Firm*—Guy W. Shoup

[57] ABSTRACT

A photosensitive drum includes a cylindrical core which may be fixedly mounted on a rotating shaft and which is comprised of an elastic material and an outer sleeve which is provided on the outer peripheral surface of the core and which includes a supporting layer and a photosensitive layer formed on the supporting layer. A combination of the elastic core and the outer sleeve is constructed such that the drum only deforms locally at a point where an external force is applied and its immediate vicinity while maintaining the other portion virtually unchanged. In one form, the outer sleeve is fixedly mounted on the core, and, in another form, the outer sleeve is detachably mounted on the core. In the latter case, it is so structured that no relative movement takes place between the core and the outer sleeve even if external forces are applied to the drum.

20 Claims, 9 Drawing Figures

LOCALLY DEFORMABLE PHOTOSENSITIVE DRUM FOR USE IN ELECTROPHOTOGRAPHY

BACKGROUND OF THE INVENTION

1. Field of the Invention

This invention generally relates to an image forming member for forming an electrophotographic image thereon and particularly to a photosensitive drum for use in electrophotography. More specifically, the present invention relates to a photosensitive drum including an elastic core around which an outer layer comprised of an elastic supporting layer and a photosensitive layer formed on the supporting layer is provided.

2. Description of the Prior Art

A typical prior art photosensitive drum includes a rigid support and a photosensitive layer formed on the rigid support. Such a photosensitive drum is rotatably mounted in a housing of a copier and driven to rotate in a predetermined direction at constant speed. During a copying operation, an electrostatic latent image is formed on the photosensitive layer of the drum, which is then developed by a developing device to be converted into a visible image. Such a rigid photosensitive drum suffers from the following disadvantages.

That is, in the case where the developing device is structured such that use is made of a developing roller as a developer carrier for transporting a single component developer or magnetic toner as carried thereon along a predetermined path and the toner is charged to a predetermined polarity due, for example, to friction against the developing roller during such transport, whereby the toner thus charged is applied to an electrostatic latent image formed on the drum, it is preferable to form a toner layer on the developing roller as thin as possible, ideally to the thickness which corresponds to the size of a single toner particle, in order to have the toner layer uniformly charged. Because, if the toner layer formed on the developing roller is thicker, it is difficult to have the toner layer charged uniformly in the thickness direction, thereby deteriorating the quality of resultant visible image.

On the other hand, in order to form a thin toner layer on the developing roller, which is then transferred to an electrostatic latent image on the photosensitive drum to obtain a visible image of high quality, it is required to bring the toner on the developing roller into contact with or to a position spaced apart over a small gap from the surface of the photosensitive drum at an opposed region between the developing roller and the photosensitive drum. However, if the photosensitive drum is rigid, it is not easy to bring the extremely thin toner layer on the developing roller into contact with or to a position spaced apart over a small gap from the surface of the photosensitive drum. Because, when the photosensitive drum and the developing roller are brought into pressure contact or arranged extremely closely, especially when the surface of the developing roller is rigid, if slight distortions are present in the surface of the photosensitive drum or developing roller or their outer diameters are slightly inaccurate due to manufacturing tolerances, there is formed a relatively large gap between the drum and the developing roller or the developing roller is pressed against the drum locally with an excessively large force thereby causing damages to the surface of the drum.

It is extremely difficult to manufacture the photosensitive drum or developing roller at high accuracy to the extent that no surface distortions and outer diameter fluctuations are present at all. In order to cope with such inconveniences, use may be made of a photosensitive belt in place of the rigid photosensitive drum, in which the developing roller is pressed against the belt to bring the toner on the developing roller into contact with the surface of the belt uniformly. Using a photosensitive belt requires to provide at least two supporting rollers, and, moreover, it becomes more complicated structurally and expensive. Thus, to use a photosensitive belt instead of the drum does not solve all of the problems.

SUMMARY OF THE INVENTION

It is therefore a primary object of the present invention to obviate the disadvantages of the prior art as described above and to provide an improved photosensitive drum for use in electrophotography.

Another object of the present invention is to provide an elastic photosensitive drum capable of producing an image of high quality.

A further object of the present invention is to provide an elastic photosensitive drum simple in structure and thus easy to manufacture.

A still further object of the present invention is to provide an elastic photosensitive drum which is so structured to be deformed only locally where required.

Other objects, advantages and novel features of the present invention will become apparent from the following detailed description of the invention when considered in conjunction with the accompanying drawings.

DESCRIPTION OF THE PREFERRED EMBODIMENTS

Figure 1:
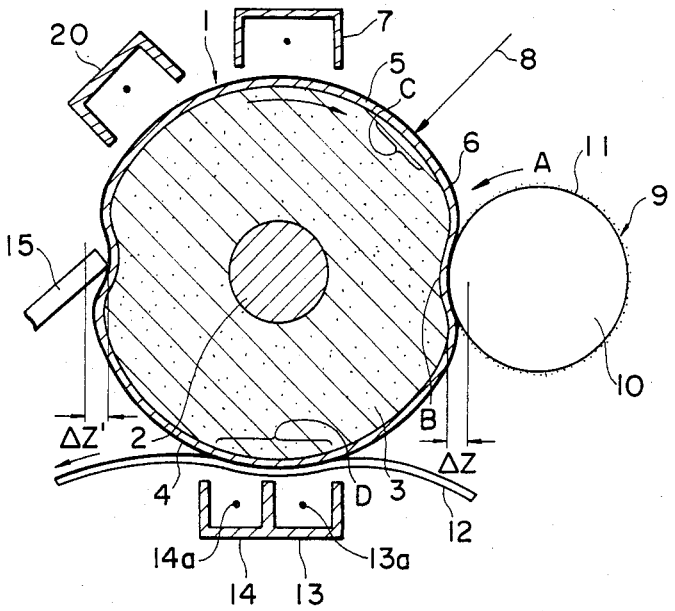
FIG. 1 is a schematic illustration showing the overall structure of one example of electrophotographic copying machine employing the elastic photosensitive drum constructed in accordance with one embodiment of the present invention.
Figure 2:
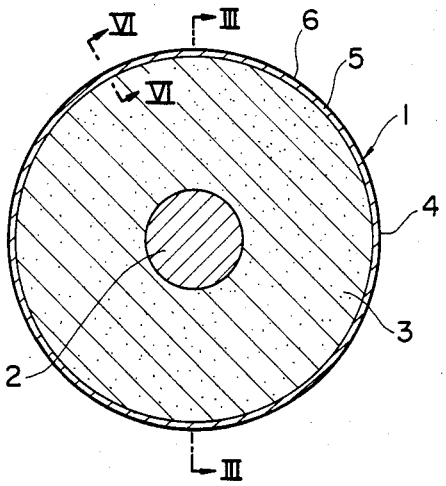
FIG. 2 is a transverse cross-sectional view of the photosensitive drum employed in the structure of FIG. 1 when no external force is applied thereto.
Figure 3:
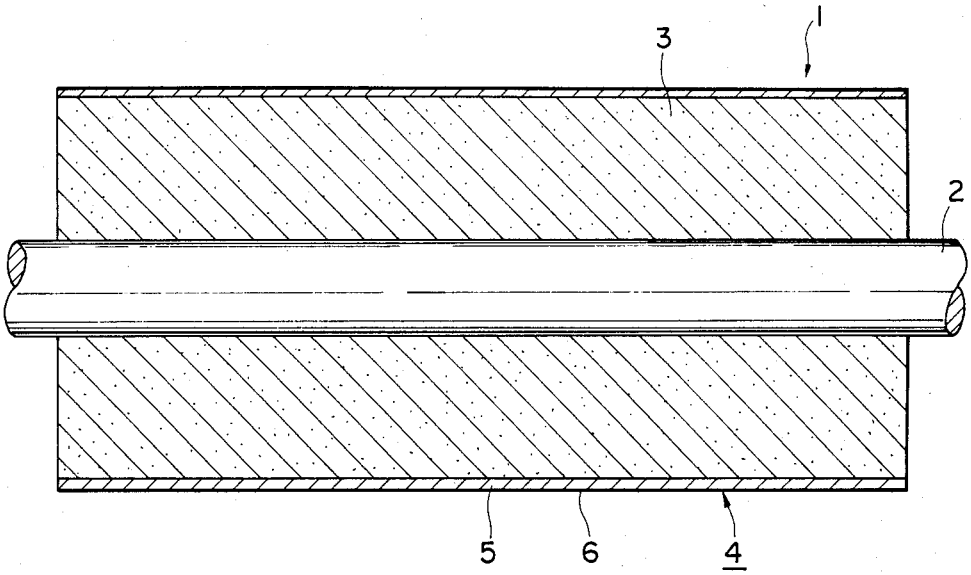
FIG. 3 is a longitudinal cross-sectional view taken along line III—III shown in FIG. 2.

Referring now to FIG. 1, there is schematically shown the overall structure of an electrophotographic copying machine which employs an elastic photosensitive drum 1 constructed in accordance with one embodiment of the present invention. As shown, the photosensitive drum 1 includes a cylindrical core 3 which is comprised of an elastic material and supported on a rigid shaft 2, which, in turn, is rotatably mounted on a housing or main frame (not shown) of the copying machine, and a sleeve-shaped outer layer 4 which is provided around the peripheral outer surface of the core 3. In the illustrated example, the cylindrical core 3 is integrally affixed to the shaft 2, which is coupled to a driving device (not shown) to be driven to rotate in a predetermined direction at constant speed. As will be described more fully later, the surface of the photosensitive drum 1 deforms when an external force is applied thereto; however, without the presence of such an external force, the outer peripheral surfaces of the elastic core 3 and the outer layer 4 are cylindrical and concentric with the rotating axis of shaft 2, as illustrated in FIGS. 2 and 3.

Figure 4:
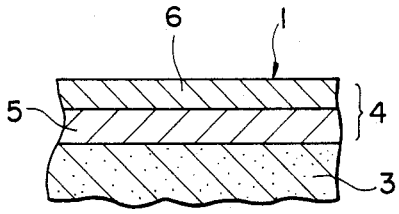
FIG. 4 is a cross-sectional view taken along line VI—VI shown in FIG. 2.

As clearly shown in FIG. 4, the outer layer 4 includes a supporting layer 5 and a photosensitive layer 6 formed on the surface of the supporting layer 5, for example, by coating. Similarly with the photosensitive layer in the prior art photosensitive drum, the photosensitive layer 6 may be preferably comprised of a photoconductive material, inorganic or organic, such as, OPC (organic photoconductor), zinc oxide, selenium and various amorphous materials. The supporting layer 5 may, for example, be comprised of an elastically deformable material, such as a thin metal plate, and, similarly with the prior art, the supporting layer 5 in the present embodiment possesses the property of electrical conductivity (normally, volumetric resistivity of $10^9$ ohms-cm or less). The elastic core 3 may, for example, be comprised of a non-foam material, such as rubber, or an appropriate foam material including sponge. Since the photosensitive drum 1 includes the elastically deformable outer layer 4 and the elastic core 3, the surface of the drum 1 may deform suitably and locally when an external force is applied thereto.

During a copying operation, the photosensitive drum 1 is driven to rotate clockwise as viewed into FIG. 1 by means of a driving device (not shown). Similarly with the case of an ordinary electrophotographic copying machine, as the photosensitive drum 1 is driven to rotate, the photosensitive layer 6 is uniformly charged to a predetermined polarity by a corona charger 7 and the thus charged portion of the layer 6 is exposed to a light image 8 from an original (not shown) at an exposure region C, so that an electrostatic latent image is formed on the layer 6 in accordance with the pattern of the light image thus exposed.

The developing device 9 includes a developing roller 9 which is driven to rotate counterclockwise as indicated by the arrow A and around the peripheral surface of which is formed a thin film 11 of toner (single component developer) supplied from a tank (not shown). The thin film 11 of toner is thus transported in the direction A as carried on the outer peripheral surface of the roller 10 as the roller 10 is driven to rotate. The toner forming the film 11 becomes charged to a predetermined polarity (normally to the polarity opposite to the polarity of uniform charge on the photosensitive layer 6) due, for example, to contact with the developing roller. The toner film 11 formed on the developing roller 10 is extremely thin and in the order of one or two toner particles of 5–10 microns in diameter, and, thus, the toner film 11 can be uniformly charged across its thickness.

When brought into an opposed region between the photosensitive drum 1 and the developing roller 10, the thus charge toner on the developing roller 10 comes into contact with the surface of the photosensitive drum 1 whereby the toner is selectively transferred to the drum 1 in accordance with the charge pattern of an electrostatic latent image formed on the drum to visualize the latent image. In this instance, the developing roller 10 is pressed against the elastic drum 1, and, thus, that portion of the drum 1 which is in contact with the roller 10 with the toner film 11 sandwiched therebetween as indicated by B and its vicinity are elastically deformed in the form of a dent. For this reason, although the toner film 11 formed on the developing roller 10 is extremely thin, it may be brought into contact with the surface of the photosensitive drum 1 securely.

In order to keep the toner attracted to the outer peripheral surface of the developing roller 10, the developing roller 10 may be structured in the form of a sleeve with the provision of one or more of magnets inside of such a sleeve-shaped developing roller. Alternatively, the toner may be transported as attracted to the outer peripheral surface of the roller 10 due to friction between the surface of the roller 10 and the toner. In the former case, the toner must be comprised of a magnetic material; on the other hand, in the latter case, the toner may be non-magnetic in nature. When magnets are disposed inside of a sleeve-shaped developing roller, the magnets may be rotated instead of the roller, or both of the magnets and the roller may be set in rotation, and the direction of rotation of each of the magnets and roller may be set arbitrarily.

The developed image thus formed on the drum 1 is then transferred to transfer paper 12, which is brought into contact with the surface of the drum 1, by means of an image transfer corona charger 13, and then the transfer paper 12 is separated away from the surface of the drum 1, for example, by a separating corona charger 14. Of course, in place of or in addition to the separating corona charger 14, provision may be made of a separating pawl (not shown) which may physically separate the transfer paper from the surface of the drum 1. As shown in FIG. 1, a region D is a separating and transferring region, as described above.

The residual toner remaining on the peripheral surface of the drum 1 after image transfer is removed by means of a cleaning blade 15 whose tip end is pressed against the peripheral surface of the drum 1, as shown in FIG. 1. Thereafter, the peripheral surface of the drum 1 is discharged by a discharging unit 20. Of course, use may be made of a magnetic cleaning brush or fur brush in place of the cleaning blade, as described above.

As shown in FIG. 1, the photosensitive drum 1 deforms locally as pressed by the developing roller 10 and the cleaning blade 15, and the developing roller 10 and the cleaning blade 15 are so disposed that such deformation remains within an elastic deformation limit. In order to bring the toner film on the developing roller 10 into contact with the photosensitive drum 1 uniformly and stably, the amount of deformation ($\Delta Z$) of the peripheral surface of the drum 1 in the radial direction by the developing roller 10 may range from 0.1 mm to 0.5 mm, and the amount of deformation ($\Delta Z'$) by the cleaning blade 15 may also be set to 0.5 mm or less. If use is made of magnetic or fur brush in place of the cleaning blade 15, the amount of deformation of surface of the drum 1 may be made smaller.

With the above-described structure, the peripheral surface of the drum 1 may elastically deform in the form of a dent, and, thus, the developing roller 10 may be pressed against the drum 1 to locally and elastically deform the surface of the drum 1 in the radial direction. Accordingly, even if the peripheral surfaces of photosensitive drum 1 and developing roller 10 are slightly eccentric with respect to their rotating or central axses, there are fluctuations in the outer diameters due to manufacturing tolerances, or the surface of the developing roller 10 is rigid, no damages will be produced on the surfaces of drum 1 and developing roller 10 and the toner on the developing roller 10 may be brought into contact with the drum 1 more securely as well as stably than the prior art structure. Thus, it is possible to prevent the quality of developed image from being deteriorated due to a large gap formed between the toner on the developing roller 10 and the surface of the drum 1. Moreover, when it is so structured that the developing roller 10 is not pressed against the surface of the drum 1 with the toner sandwiched therebetween but arranged opposite to the surface of the drum 1 with a small gap therebetween, the distance between the developing roller 10 and the surface of the drum 1 can be prevented from becoming too large. When the drum 1 and the developing roller 10 are arranged closely together, even if they come into contact partly with the toner sandwiched therebetween, the drum 1 locally deforms elastically and there is no fear of producing any damage to either of the drum 1 or developing roller 10.

Figure 5:
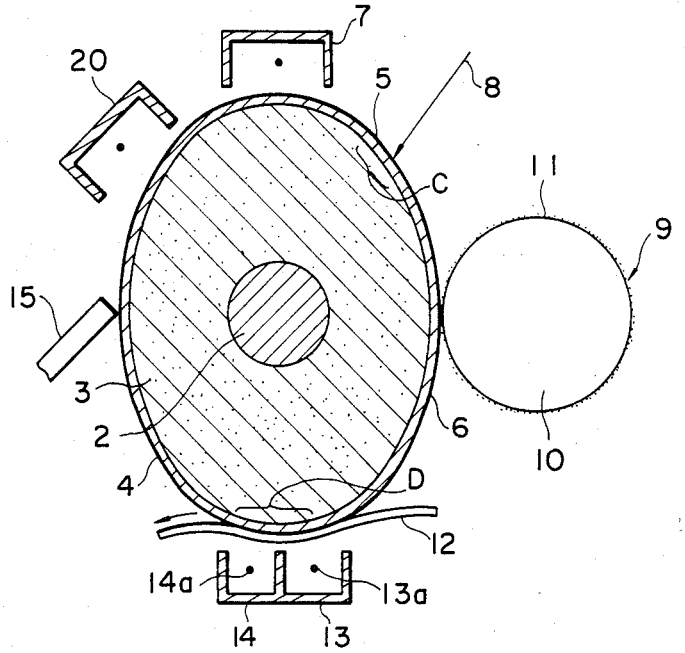
FIG. 5 is a schematic illustration showing the case in which the elastic photosensitive drum is undesirably deformed.

With the surface of the photosensitive drum 1 structured to be elastically deformable, as described above, preferred results may be obtained in visualizing the electrostatic latent image. However, if the drum 1 deforms not only locally at those surface portions including the surface portion where the external force is applied and its vicinity but also other surface portions under the influence of the applied external force, as schematically shown in FIG. 5, there arises a situation which is not preferable to the formation of an image on the drum 1 or transfer paper. That is, as also described previously, if that portion of the surface of the drum 1 which is located at exposure region C deforms as shown in FIG. 5, an image cannot be formed properly in this region C. Besides, if use is made of corona units 13 and 14 as transferring and separating devices, respectively, as in the illustrated embodiment, when the surface of the drum 1 deforms unevenly at the transferring and separating region D, the distance from corona wires 13*a* and 14*a* to the surface of the drum 1 varies, so that transfer of developed image cannot be carried out properly and there is a possibility of producing disturbances in the image on the transfer paper or failure of separation of the transfer paper 12. In order to cope with this, the drum 1 is so structured to be deformable only at a point where the external force is applied and its vicinity with the other portion remaining virtually unchanged. Even if the other portion is also changed under the influence of the applied external force, it is preferable that the amount of deformation in the radial direction of the drum 1 is limited to 0.1–0.5 mm at most.

As described above, in accordance with the present invention, a combination of the cylindrical core 3 and the outer layer 4 is so structured that when external forces are applied to the peripheral surface of the drum 1 by means of various process devices arranged around the drum 1, only those portions of the surface of the drum 1 where the external forces are applied are deformed with the remaining portions virtually unchanged.

Figure 6:
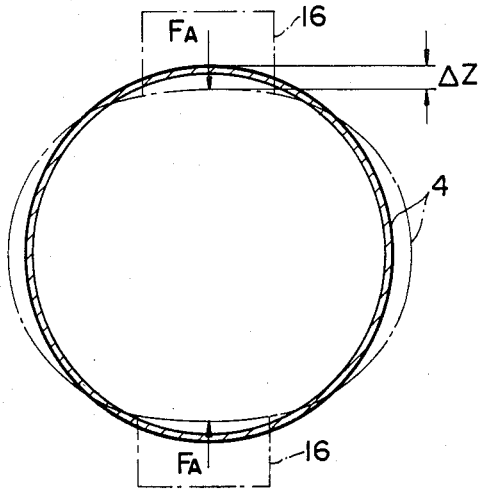
FIG. 6 is a schematic illustration showing as an example how the outer layer of the photosensitive drum deforms when the external force is applied thereto.

FIG. 6 illustrates the cylindrical outer layer 4 as removed from the core 3. Suppose that a pair of oppositely arranged pressure members 16, 16 are pressed against the cylindrical outer layer 4 diametrically to apply external force $F_A$ thereto thereby having those portions to which the external force $F_A$ is applied elastically deformed by the amount $\Delta Z$, which corresponds to the amount of deformation produced when the drum 1 is compressed. In this case, if the cylindrical outer layer 4 is comprised, for example, of metal, the cylindrical outer layer 4, to which the external force $F_A$ is applied, deforms wholly, as indicated by the one-dotted line in FIG. 6, so that the shape of the transverse cross section normally becomes elliptic. Then, with the external force $F_A$ removed, the outer layer 4 returns to the original cylindrical shape.

Figure 7:
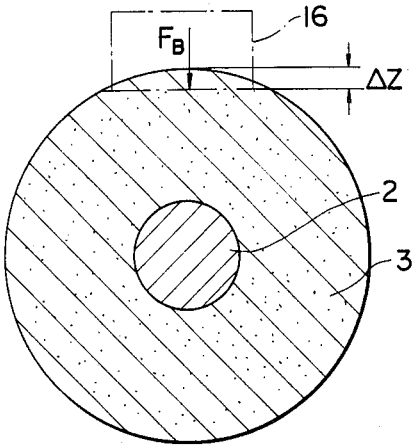
FIG. 7 is schematic illustration showing as an example how the core of the photosensitive drum without the outer layer deforms when the external force is applied thereto.

FIG. 7 illustrates the elastic, cylindrical core 3 fixedly supported on the shaft 2 with the outer layer 4 removed therefrom. Although not shown specifically, it is to be understood that in the state of FIG. 7 the shaft 2 is fixedly supported on both ends and a pressure member 16 is pressed against the core 3 radially inwardly to apply an external force $F_B$ to have that portion where the external force $F_B$ is applied deformed under compression by the same amount $\Delta Z$ as in the case of FIG. 6. In this case, since the core 3 is comprised of an elastic material, such as a non-foam material like rubber and a foam material, the core 3 deforms only at the point where the external force $F_B$ is applied and its vicinity with the other portion remaining substantially unchanged. In this case, it is preferable to structure such that forces $F_A$ and $F_B$ required for deforming the outer layer 4 and core 3 by $\Delta Z$, respectively, satisfy the condition of $F_A$ being equal to or smaller than $F_B$, more preferably $F_A$ being smaller than $F_B$. Put it another way, if it is so structured that the outer layer 4 is more easily elastically deformable than the core 3, if an external force is applied to a combined structure between such outer layer 4 and core 3 (FIG. 1), the outer layer 4 will deform in compliance with the core 3 as indicated in FIG. 1 and the drum 1 will not deform wholly as indicated in FIG. 5. Conversely, if the forces $F_A$ and $F_B$ applied to the drum 1 to have it deformed by the amount of $\Delta Z$ are such that $F_A$ is larger than $F_B$, then the drum 1 will most likely to deform as illustrated in FIG. 5.

Thus, by arranging the exposure region, transfer region and separating region at those portions of the surface of the drum 1 where virtually no deformation takes place even if external forces are applied, the beforementioned disadvantages may be prevented from being produced. In the preferred embodiment, even if deformation takes place in the radial direction of the drum 1 at those portions of the surface of the drum 1 located in the exposure, transfer and separation regions, the amount of such deformation may be limited to 0.5 mm or less.

In order to satisfy the above-described condition of $F_A$ being equal to or smaller than $F_B$, the outer layer 4, or to be more exact the supporting layer 5 may be comprised of a material, such as nickel, stainless steel and aluminum. In this case, nickel and stainless steel are relatively high in durability and Young's modulus, and, thus, if these materials are used to form the supporting layer 5, it is preferable to make its thickness 100 microns or less. If the thickness is larger than 100 microns, it is difficult to deform the outer layer 4 without increasing the external force to be applied to the drum 1, and, thus, the scope of selection of material for the core 3 to maintain the relation of $F_A$ being equal to or smaller than $F_B$ becomes limited, thereby making the photosensitive drum 1 liable to deform undesirably as shown in FIG. 5. On the other hand, if the supporting layer 5 of outer layer 4 is comprised of aluminum, since aluminum is smaller in durability and Young's modulus than nickel and stainless steel, it is preferable to make it a little thicker and it has been empirically found to be advantageous to set the thickness to be 200 microns or less. Although it is preferable to make the supporting layer 5 as thin as possible as set forth above, it is also preferable for the outer layer 4 to return to the original cylindrical shape completely when the external force is removed, so that it goes without saying that the thickness of the supporting layer 5 should not be set too thin to the extent that plastic deformation takes place whatever material is selected to form the supporting layer 5.

Forming the supporting layer 5 of outer layer 4 using a material selected from those mentioned above and setting its thickness preferably in the range also mentioned above, the material for the core 3 which satisfies the condition of $F_A$ being equal to or smaller than $F_B$ may be selected from a wide variety, including common non-foam rubber and an appropriate foam material. Of course, it is preferable to select an appropriate material having a certain degree of hardness allowing to obtain a desired amount of elastic deformation such that when the external force is applied to the core 3, as shown in FIG. 7, deformation takes place only at the point of application of external force and its immediate vicinity and virtually no deformation takes place at any other portion, and a certain degree of elasticity which allows the elastic core 3 to return to its original cylindrical shape when the external force is removed and which allows to prevent plastic deformation from taking place even if the external force is applied to the core 3 for a long period of time.

According to the experiments, preferred results were obtained with the core 3 comprised of polyurethane foam material called "micro cell rubber" (tradename) and manufactured by U.S. Rodgers corporation. This material had the hardness of 20° when measured by the rubber hardness meter JIS (Japanese Industrial Standards) C type. This micro cell rubber was compressed to 50% of its thickness and its condition was maintained for 22 hours at the temperature of 158° F., and, thereafter, the pressure was released and 10% of permanent deformation remained. However, such amount of permanent deformation is significantly smaller as compared with the amount of permanent deformation of common foam material which is approximately 30%, so that it may be understood that micro cell rubber is particularly suited as a material for the core 3.

As another embodiment, the cylinder 4 including the nickel sleeve of 50 microns as the supporting layer was fitted onto the cylindrical core 3 of micro cell rubber. In this case, the outer diameter of cylindrical core 3 before fitting was set 1 mm larger than the inner diameter of cylinder 4 and the cylindrical core 3 after fitting was compressed by 0.5 mm in the radial direction all around its peripheral surface to form the drum 1. Then, the drum 1 thus manufactured was mounted in a copying machine as illustrated in FIG. 1 and tested to find the ability to deform preferably as illustrated in FIG. 1.

As a further embodiment, use was made of micro cell rubber of hardness 5° (C type) to form the cylindrical core 3 and the nickel sleeve 5 was made thinner to 25 microns thereby increasing deformability. This embodiment was also found to deform suitably as shown in FIG. 1. It is true that the hardness of core 3 may be decreased by making the sleeve 5 thinner, but if this hardness is decreased exceedingly, the sleeve 5 must also be made extremely thinner, so that there arises a possibility that plastic deformation takes place. On the contrary, if the hardness of core 3 is set too high, the drum 1 becomes difficult to deform. Thus, the hardness (C type) of core 3 was found to be advantageous to set in the range between approximately 5° and 50° from a practical view point.

Figure 8:
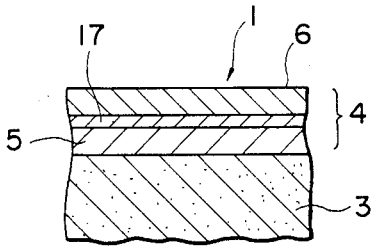
FIG. 8 is a cross-sectional view of another embodiment of the present invention taken similarly as in the case of FIG. 4.

In the above-described embodiment, use was made of a metal sleeve for the supporting layer 5; however, use may be made of any other material, such as an electrically conductive rubber. Furthermore, the drum 1 of the above-described embodiment was comprised of the cylindrical core 3 and the outer layer 4. However, as long as required deformation may be obtained at the surface of the drum 1, additional layers may be provided appropriately. In addition, instead of forming the outer layer 4 as a combination of the supporting layer 5 and the photoconductive layer 6 as described above, an intermediate layer 17 of electrically conductive material having the volumetric resistivity, for example, of $10^9$ ohms-cm or less may be provided as interposed between the supporting layer 5 and the photoconductive layer 6, as shown in FIG. 8, thereby allowing to prevent the sensitivity of photoconductive layer 6 from being deteriorated. The intermediate layer 17 may be comprised of aluminum vapor-deposited onto the supporting layer 5, or any other appropriate inorganic or organic material.

As well known in the art, in order to form an electrostatic latent image on the photosensitive drum 1, the supporting layer 5 or intermediate layer 17 must be connected to ground. For this purpose, the supporting layer 5 or intermediate layer 17 may be connected to ground via an appropriate conductor (not shown) without impairing intended deformation of the drum 1. In such a case, the shaft 2 may be comprised of an electrically conductive material and the supporting layer 5 or intermediate layer 17 may be connected to ground via the electrically conductive shaft 2 and a conductor, such as fine wire or foil, interconnecting the shaft 2 to the supporting layer 5 or intermediate layer 17, whereby such a conductor may be provided as embedded in the core 3 in a deformable manner. Alternatively, if the core 3 is comprised of an electrically conductive material, such as electrically conductive rubber, the intermediate layer 17 or supporting layer 5 may be connected to ground without using the above-mentioned fine wire or foil. Further, as may have already been understood, if the intermediate layer 17 of electrically conductive material is provided as connected to ground, the supporting layer 5 may, for example, be comprised of an insulating material, such as electrically insulating rubber.

It is also to be noted that the outer layer 4 may be adhesively adhered to the core 3, but, as will be described more fully later, the outer layer 4 may also be provided as detachably mounted on the core 3. In the latter case, there is an advantage of ability to replace the outer layers.

Figure 9:
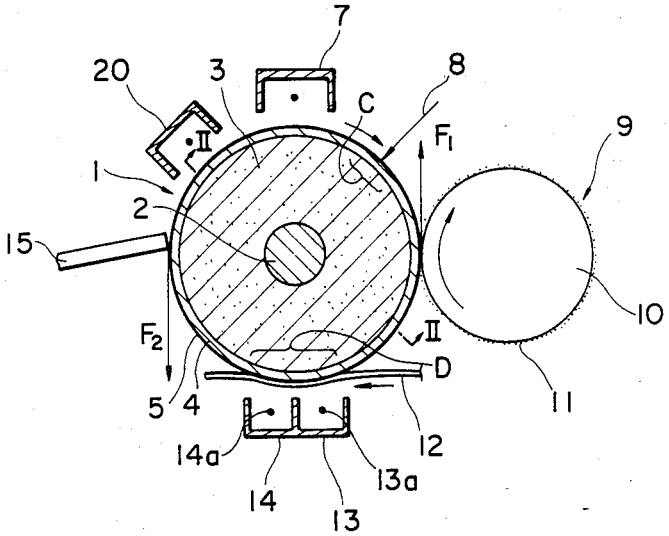
FIG. 9 is a schematic illustration showing the overall structure of the copying machine to which the elastic photosensitive drum constructed in accordance with a further embodiment of the present invention is employed.

Now, referring to FIG. 9, another embodiment of the present invention, in which the outer layer 4 is detachably mounted on the cylindrical core 3, will be described in detail below. Since the embodiment of FIG. 9 is similar to the embodiment of FIG. 1 in many respects, like numerals are used to indicate like elements. In this embodiment, however, the outer layer 5 may be mounted in position simply by having it fitted onto the cylindrical core 3 and it may be easily dismounted from the core 3. Although the outer layer 4 may be easily mounted on the core 3, care must be exercised such that the outer layer 5 does not move with respect to the core 3 during operation. If such a relative movement takes place, the quality of an image formed on the surface of the drum 1 would be deteriorated most likely. In particular, in the copying machine as disclosed in FIG. 9, there are disposed the developing roller 10 and the cleaning blade 15 around the periphery and as pressed against the drum 1. Thus, due to friction between the peripheral surface of the drum 1 and each of these process elements, there are produced external forces $F_1$ and $F_2$ acting on the drum 1 tangentially, which tend to move or rotate the outer layer 4 with respect to the core 3.

For example, the cleaning blade 15 comprised, for example, of rubber applies a pressure force of 1–3 Kg to the surface of the drum 1, and thus a frictional force corresponding thereto is applied to the drum 1. However, the force applied to the drum by the developing roller 10 is normally smaller than the force applied by the blade, so that it may be made as small as can be neglected as compared with the force applied by the blade 15. If use is made of a separating pawl in place of or in addition to the separating charger 14, such a pawl also applies an external force to the drum 1. Under the circumstances, it is preferable to adopt at least one of the following structures.

(1) The inner peripheral surface of the outer layer 4 and the outer peripheral surface of the core 3 are made larger in their coefficients of friction, thereby making it difficult to cause a relative motion between the outer layer 4 and the core 3.

(2) The outer diameter of the core 3 before interference fit is set larger than the inner diameter of the outer layer 4 such that, when the outer layer 4 is fitted onto the core 3, the core 3 is compressed radially inwardly over a predetermined amount around the entire peripheral surface whereby its recovery force is utilized to inhibit slippage between the two.

Since the core 3 is comprised of an elastic material, such as rubber and foam, its coefficient of friction is large, and, thus, the structure set forth in (1) may be easily attained. Moreover, since the core 3 of elastic material may be easily compressed elastically in the radial direction, the interference fit may be easily established between the core 3 and the outer layer 4 by providing a compression margin in the core 3 as set forth in (2).

By structuring as described above and establishing the condition such that a sum of the tangential forces $\Sigma F$ acting on the drum 1 caused by the external forces applied by various process elements of the copying machine ($\Sigma F = F_1 + F_2$ in the embodiment shown in FIG. 9) is smaller than a frictional force f between the outer layer 4 and the core 3, the relative motion between the outer layer 4 and the core 3 may be prevented from occurring.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. A cylindrical photosensitive drum for use in electrophotography comprising:

a cylindrical core comprised of an elastic material supported on a rigid shaft; and an outer cylindrical layer provided as integrally fitted onto an outer peripheral surface of said core, said outer layer being concentric with said drum and including a supporting layer and a photosensitive layer formed on said supporting layer, whereby said outer layer and said core, when combined, are structured such that said drum, when rotating about said rigid shaft deforms locally only at a point where an external force is applied and its immediate vicinity while maintaining the other portions virtually unchanged.

2. The drum of claim 1 wherein said external force is applied by one of process elements disposed around said drum for carrying out an electrophotographic process.

3. The drum of claim 1 wherein an amount of deformation caused by application of said external force in a radial direction of said drum is maintained within an elastic limit of said elastic material used.

4. The drum of claim 3 wherein said amount of deformation is 0.5 mm or less.

5. The drum of claim 1 wherein if forces $F_A$ and $F_B$ are required to obtain the same amount of deformation in the radial direction for said outer layer and said core separately, then said outer layer and said core are structured to satisfy a relation of $F_A$ being equal to or less than $F_B$.

6. The drum of claim 1 wherein said outer layer further includes an intermediate layer provided as sandwiched between said supporting layer and said photosensitive layer.

7. The drum of claim 6 wherein said intermediate layer is comprised of an electrically conductive material.

8. A cylindrical photosensitive drum for use in electrophotography comprising:

a cylindrical core of an elastic material supported on a rigid shaft; and an outer sleeve provided as integrally fitted onto an outer peripheral surface of said core, said outer sleeve including a photosensitive layer concentric with said drum and being detachably mounted on said core, so that said outer sleeve and said core, when combined, are structured such that said drum, when rotating about said rigid shaft, deforms locally only at a point where an external force is applied and its immediate vicinity while maintaining the other portions virtually unchanged.

9. The drum of claim 8 wherein a sum of tangential forces acting on said outer sleeve due to external forces applied thereto is denoted by $\Sigma F$ and a frictional force acting between said core and said outer sleeve is denoted by f, said outer sleeve being fitted onto said core with a relation of f being larger than ΣF, thereby allowing to prevent said outer sleeve from rotating relative to said core due to application of said external forces.

10. A cylindrical photosensitive drum for use in electrophotography comprising:

a cylindrical core of an elastic material supported on a rigid shaft; and an outer cylindrical layer provided as integrally fitted onto an outer peripheral surface of said core, said outer layer and said core, when combined, are structured such that said drum, when rotating about said rigid shaft, deforms locally only at a point where an external force is applied and its immediate vicinity while maintaining the other portions virtually unchanged.

11. The drum of claim 10 wherein said supporting layer is comprised of stainless steel.

12. The drum of claim 10 wherein said supporting layer is comprised of nickel.

13. The drum of claim 11 wherein said supporting layer is 100 microns thick or less.

14. The drum of claim 12 wherein said supporting layer is 100 microns thick or less.

15. The drum of claim 10 wherein said supporting layer is comprised of aluminum.

16. The drum of claim 15 wherein said supporting layer is 200 microns thick or less.

17. The drum of claim 10 wherein said elastic material is non-foam rubber.

18. The drum of claim 10 wherein said elastic material is a foam material.

19. The drum of claim 18 wherein said foam material is polyurethane foam.

20. The drum of claim 19 wherein said polyurethane foam has a hardness of 5°–50° when measured by the rubber hardness meter of JIS C type.

* * * * *